United States Patent [19]

Major et al.

[11] 4,454,515

[45] Jun. 12, 1984

[54] ANTENNA MOUNT

[76] Inventors: Johnny D. Major, Rte. 2, Box 174, Claremont, N.C. 28610; Granville M. Major, Jr., Rte. 2, Box 38A, Bean Station, Tenn. 37708

[21] Appl. No.: 431,723

[22] Filed: Sep. 30, 1982

[51] Int. Cl.[3] ..... H01Q 3/04

[52] U.S. Cl. ..... 343/882; 254/126; 248/122; 248/185

[58] Field of Search ..... 343/757, 765, 766, 840, 343/880, 882; 254/124, 126; 248/122, 185

[56] References Cited

U.S. PATENT DOCUMENTS

| | | | |
|---|---|---|---|
| 3,440,659 | 4/1969 | Kreitzberg | 343/882 |
| 3,509,578 | 4/1970 | Cribb | 343/882 |
| 3,553,732 | 1/1971 | Glynn | 343/840 |
| 3,832,717 | 3/1972 | Taggart | 343/840 |
| 3,945,015 | 3/1976 | Gueguen | 343/765 |
| 4,232,320 | 11/1980 | Savalle | 343/765 |
| 4,251,819 | 2/1981 | Vickland | 343/882 |
| 4,284,061 | 8/1981 | Wildenrotter | 343/765 |
| 4,384,294 | 5/1983 | Crook et al. | 343/765 |

OTHER PUBLICATIONS

Long's Electronics Satellite TV Dealer Flyer No. 101, pp. 3–8.

*Primary Examiner*—Eli Lieberman
*Attorney, Agent, or Firm*—Roy B. Moffitt

[57] ABSTRACT

An antenna mount for use with a dish type antenna for variably positioning the antenna towards a predetermined point in the heavens. The mount comprises (a) an upstanding base means, (b) a telescopic tube in slidable and rotational engagement with the base for vertically and rotationally positioning the antenna along its verticle axis, (c) an elongated cross member attached to the vertically and rotationally positioning arrangement for variably positioning the antenna in the plane formed by the longitudinal axis of the elongated cross member and the mount's vertical axis and (d) a linkage-frame assembly attached to the cross member for variably positioning the antenna about the longitudinal axis of the elongated cross member.

15 Claims, 7 Drawing Figures

ANTENNA MOUNT

BACKGROUND OF THE INVENTION

The present invention relates to an antenna mount for supporting a dish shaped antenna and positioning same at a predetermined point in the heavens. Such antenna mounting can be used for a variety of purposes, such as support means for microwave transmission and receiving means, but finds its primary utility in receiving satellite transmission signals, particularly satellite television signals. Such satellites are each orbiting about the equator and such orbit and satellite rate of speed is so designed so that in combination with the rotation of the earth, the satellite appears to remain stationary at a given point in the heavens relative to the earth surface. Obviously, an antenna used to collect electrical signals from satellite transmitters must be mounted upon an apparatus designed so that the antenna may be aimed at a satellite and be re-aimed to still another satellite in another point of the heavens at will, all with a degree of precision.

In order to accomplish such "aiming," the satellite (dish shaped) antenna must be mounted on a mount that will permit the antenna to be positioned along the conventional xyz axis of three dimensional space in a convenient and precise manner. The present invention addresses this problem and provides a mounting means that will permit a variable positioning of an antenna in the vertical or "y" axis direction, a rotational positioning about the y axis in the xz plane, a variable positioning in the plane formed by an elongated cross member (pivotally attached to the last mentioned means) and the vertical axis, and a variable positioning about the longitudinal axis of the elongated cross member. The last mentioned positioning about the longitudinal axis is such that the antenna can literally be aimed or pointed from horizon to horizon, thus giving the mounting apparatus the ability to literally "sweep the heavens" to seek out all satellites in the antenna "line of sight."

Satellites that emit television signals are positioned along the equator at a height of approximately 23,500 miles from the earth's surface. A dish antenna, say located in North Carolina (Catawba County) "looking" at such satellites would not "see" the satellites, from horizon to horizon arranged in a circular path, but in an ecliptical-like path. Therefore, a mount to effectively aim a dish shaped antenna must have a means to make the antenna travel in a path like that "seen" to be formed by the satellites. This is accomplished in the present invention simply by providing a number of upstanding members on the mount's frame, e.g., four in number at the frame's corners, two of which are longer in length than the other, the shorter ones contiguous to one another and likewise the longer ones. To these upstanding members is attached the dish antenna. The frame is rotatably attached to so as tube positioned about the longitudinal axis of the elongated cross member by a linkage assembly that provides a horizon to horizon sweep in an ecliptical-like path so as to be able to position on and "see" the satellites from which the sought for television signals are sent.

SUMMARY OF THE INVENTION

The present invention is a support apparatus, more particularly an antenna mount for positioning a load, such as a dish shaped antenna, wherein the antenna can be multipositioned, i.e., positioned about the conventional xyz axis of three dimensional space. More particularly, the antenna mount disclosed is particularly suited for use with antenna used to receive television signals from satellites orbiting the earth about the equator.

In order to achieve the above stated desired multiple positioning characteristics, the invention is composed of four basic parts: a base, a means attached to the base to vertically position and rotate the mount about the mount's vertical or y axis, an elongated cross member pivotally attached to the last mentioned means to pivotally rotate the mount in the plane formed by the longitudinal axis of the elongated cross member and the mount's vertical axis and a means attached to the elongated cross member to rotate a frame portion of the mount about the longitudinal axis of the elongated cross member.

The base is an upstanding cylindrical member having attached to it lateral support members and in its position of intended use, may delimit the x, y and z axis of the mount as a whole. A portion of the base cylindrical member is in sliding rotating telescopic engagement with the vertical or "y" axis of the base and is adapted to position itself and other elements attached to it, e.g., a frame portion of the mount, in the plane formed by the longitudinal axis of an elongated cross member pivotally attached thereto and the mount's vertical axis. Located on one terminal portion of the vertical and rotating means is a yoke and nested inside and pivotally attached thereto is an elongated cross member. A turn buckle is attached to the elongated member and to the tube portion of the vertical and rotating means. By rotating the turn buckle, the elongated cross member is caused to rotate in the plane in which the elongated cross member pivotally rotates.

Attached to the elongated cross member is what is sometimes referred to herein as a linkage-frame means, which when activated causes a frame portion of this means rotatably attached thereto to be rotated about the longitudinal axis of the elongated cross member. This means comprises the aforementioned frame, a jack and a linkage assembly. Two spaced apart terminal portions of the frame are pivotally attached to opposite end portions of the elongated member and a linkage system is also pivotally attached to the frame and elongated cross member. This combination provides a means whereby upon activation of the jack the frame of the mount can be rotatably positioned about the longitudinal axis of the elongated cross member and position the frame from horizon to horizon.

To the frame is attached upstanding members that are ultimately affixed to a dish shaped antenna. The frame is generally rectangular in shape with the upstanding members affixed to the four respective corners of the rectangle. Two of the upstanding members are longer in length than the others and are positioned at contiguous corners. Such an arrangement results, upon activation of the jack, an antenna travel path that is in the nature of an eclipse, which is the path earth orbiting equitorial satellites appear to be in as observed from a fixed position on the earth.

BRIEF DESCRIPTION OF THE DRAWINGS

Other objects and advantages of the invention will become apparent from reading the following description and from the accompanying drawings, which show one embodiment thereof by way of example only in which.

DETAILED DESCRIPTION OF THE DRAWINGS

Figure 1:
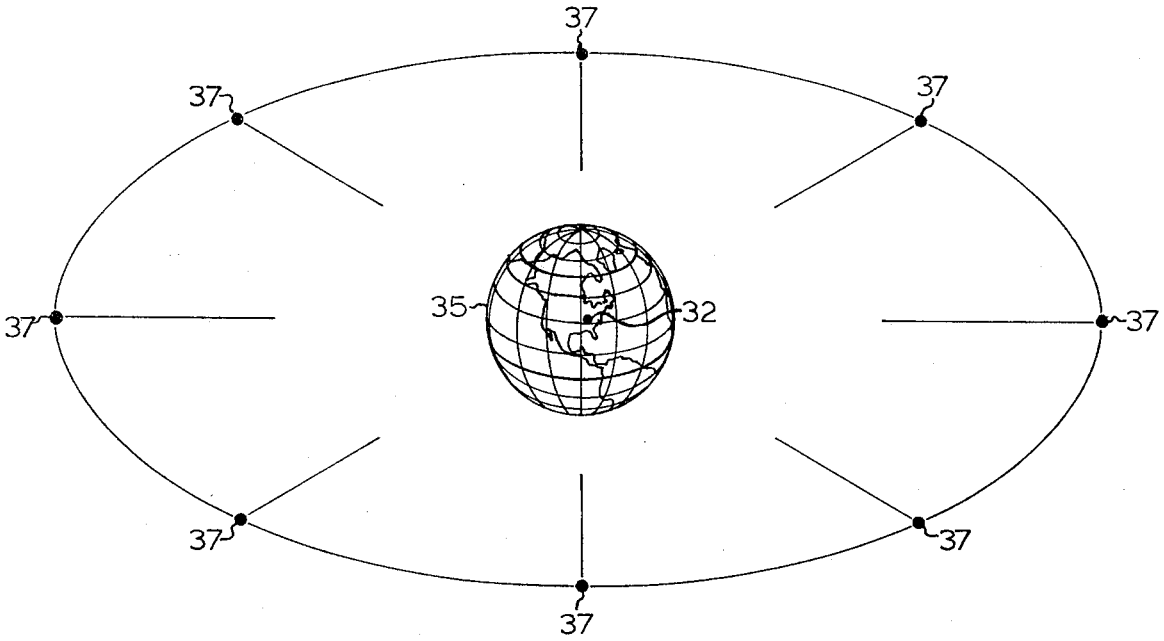
FIG. 1 is a schematic representation of the earth, dish shaped antenna location in North America and satellites orbiting about the earth's equator.

Corresponding reference characters indicate corresponding parts throughout the several veiws of the drawings.

FIG. 1 shows a stylized representation of the earth 35 on which there is an antenna 32. As previously mentioned, earth orbiting satellites 37, which transmit television signals, are generally orbiting about the equator and as a general rule are some 23,500 miles distant from the earth. A dish shaped satellite antenna 32 positioned on the earth's surface in North America, for example, Catawba County, N. C., would view the plurality of earth orbiting equatorial satellites 37 not in a circular path in a somewhat of an ecliptical path and would have to be positionable so that it could go from horizon to horizon and be aimed at anyone of the satellites. It is generally known that satellites 37, even though they are in orbit and are in constant movement, their orbital speed is so designed that in combination with rotation of the earth they appear to be standing still at a given point in heavens, as indicated by element 32 in FIG. 1. The antenna mount as disclosed describes an apparatus so that dish shaped antenna 32 can be positioned or aimed at anyone of the satellites of FIG. 1.

Figure 2:
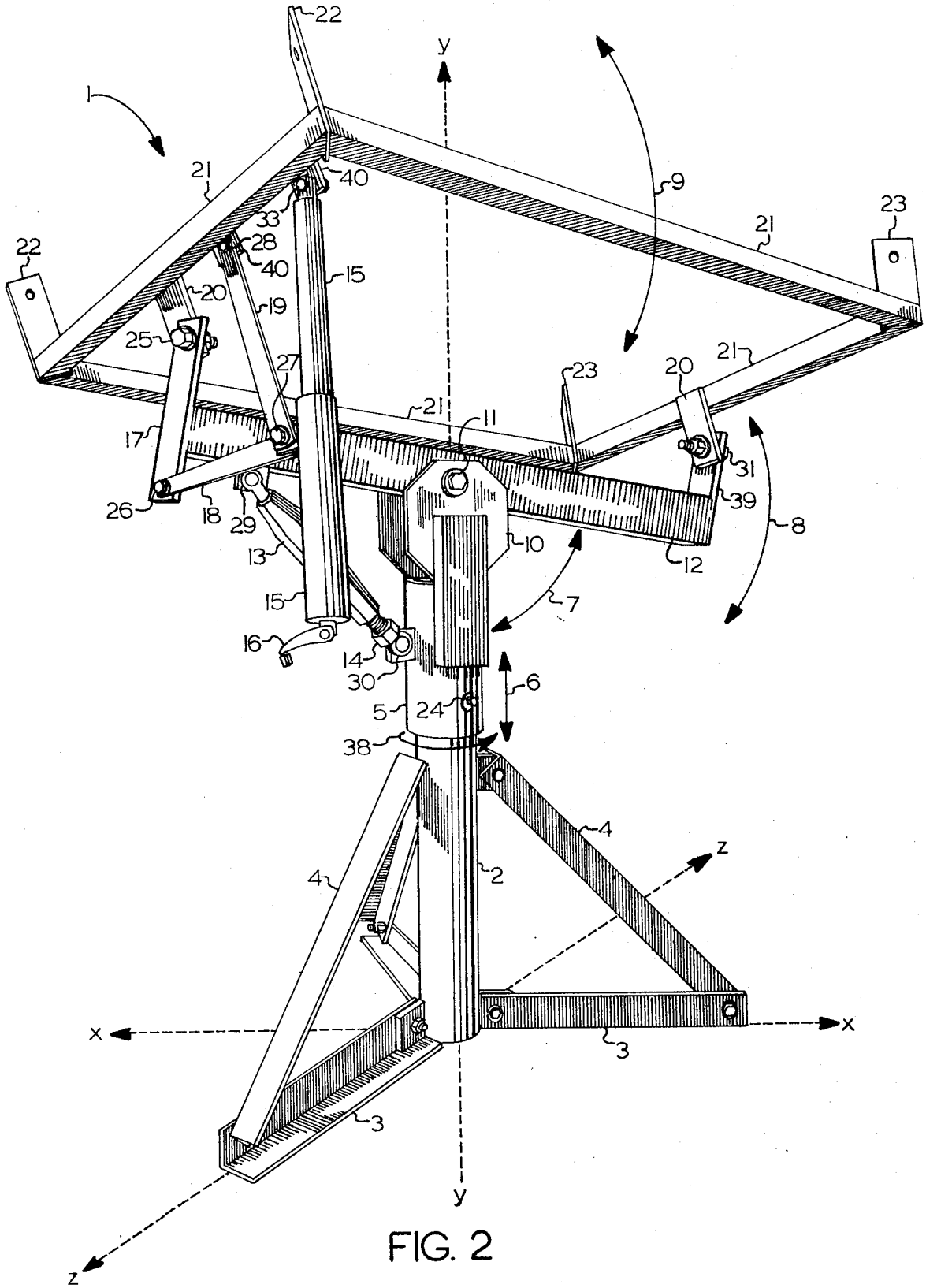
FIG. 2 is a schematic, perspective view of the mount combination according to the invention.

Referring to FIG. 2, the mount shown as element 1 in FIG. 1 is a three-dimensional object and thus has three axes, X, Y and Z.

Mount 1 as shown in FIG. 2 is comprised of basically four parts: a base, a means attached to the base for vertically and rotationally positioning elements of the mount attached thereto along and about the mount's y or vertical axis; an elongated cross member pivotally attached to the vertical and rotational means for positioning a frame attached to this means in the plane formed by the longitudinal axis of the elongated cross member and the vertical axis of the mount; and a means for positioning the aforementioned frame about the longitudinal axis of the elongated cross member. The base is composed of an upstanding cylindrical member 2. Attached to base cylindrical member 2 are support means 3 and 4 and with cylindrical tube 2 delimit the xyz axis of the mount itself. Support means 3 and 4 can be any convenient shape and made from any convenient materials. Conventional angle 1 has been found to be satisfactory.

Attached to the base is a means to vertically and rotationally position the elements of mount attached thereto along and about the mount's vertical or y axis, comprised primarily of tube member 5, which is connected to yoke member 10. Nestled inside of the y-shaped members of yoke 10 is elongated cross member 12, pivotally attached to yoke 10 by a nut and bolt arrangment shown at 11. Referring back to tube member 5, there is disposed therein a fixing means 24, a threaded bolt, which when screwed to a predetermined depth engages cylinder 2 thereby affixing tube 25 to cylinder 2. Cylinder 5 is in telescopic sliding and rotational engagement with cylinder 2 thereby permitting not only vertical movement of frame 21 and the elongated cross member 12 means along the y axis to a desired position, but also a rotational positioning of the base and/or frame 21 and elongated cross member merely by rotating tube 5 relative to cylinder 2. See elements 38, 6 and FIG. 4.

Figure 3:
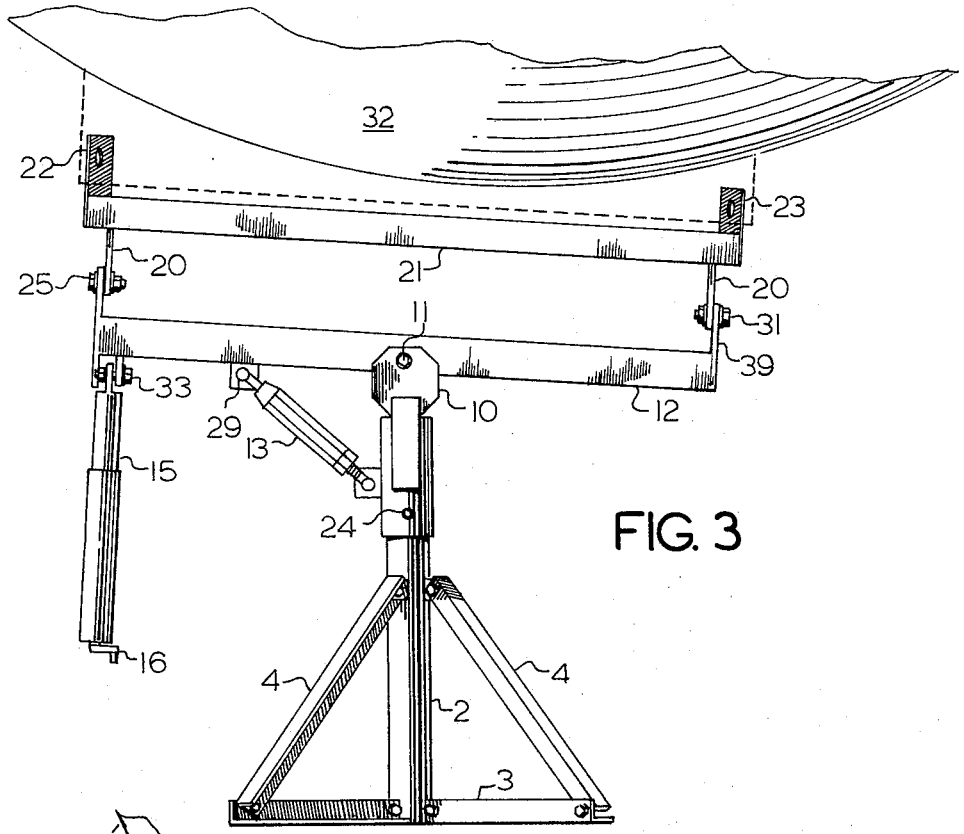
FIG. 3 is a side elevation of the mount with an antenna attached thereto showing the antenna in one position of a plane formed by the longitudinal axis of the mount's elongated cross member and the mount's vertical axis.
Figure 4:
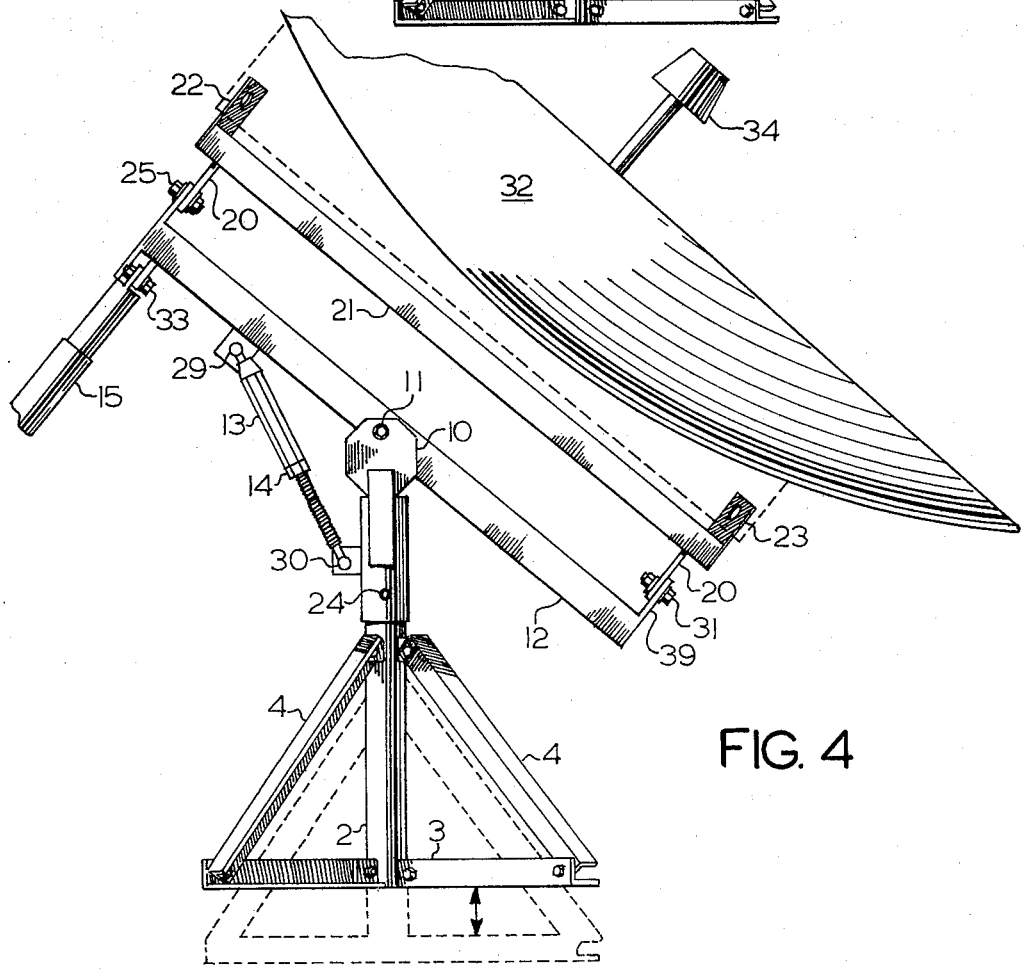
FIG. 4 is a side elevation view of the invention as shown in FIG. 3 showing the antenna in another position in a plane formed by the longitudinal axis of the mount's elongated cross member and the mount's vertical axis.

Elongated cross member 12, being pivotally attached to yoke 10, is movable in the direction of the arrows of element 7 in the plane formed by longitudinal axis of the elongated cross member and the mount's vertical y axis. This is accomplished by turn buckle 13, which is pivotally attached to cylinder 5 and to elongated cross member 12 by nut and bolt elements 30 and 29 respectively. Referring briefly to FIGS. 3 and 4, one will immediately become aware of the two extreme positions of turn buckle 13, namely the collapsed position shown in FIG. 3 and the fully extended position in FIG. 4. Obviously any position between these two extremes can also be accomplished. Nut 14, a common place component of a turn buckle, is used to "set" any position between that shown in FIG. 3 and FIG. 4 as well as these two positions. Rotational positioning of elongated cross member 12, see elements 7 and 8, accomplishes the positioning of antenna 32 (see FIGS. 3 and 4) in the plane formed by the mount's vertical axis and the longitudinal axis of the elongated cross member. Element 34 is a prior art type low noise amplifier customarily associated with antenna of this type.

Frame 21 is pivotally attached to elongated cross member member 12 at one end by nut and bolt elements 20 and 31. Element 39, an upstanding member attached to elongated member 12, is pivotally attached by nut and bolt arrangement 31 to upstanding member 20, which is affixed to frame 21. On the other end of elongated member 12 is a like upstanding member 20, which is pivotally attached to linkage member 17 by nut and bolt arrangment 25. Linkage member 17 is fixedly attached to terminal end of elongated member 12. Pivotally attached to linkage member 17 by nut and bolt arrangement 26 is an additional linkage member 18. Linkage member 19 is pivotally attached to upstanding member 40 by nut and bolt arrangment 28. Upstanding member 40, like upstanding member 20, is fixedly attached to frame 21. Jack means 15, having a handle 16, is pivotally attached to another upstanding member 40 by nut and bolt arrangement 33. Jack 15 is pivotally attached to linkage arms 18 and 19 by nut and bolt arrangment 27. Jack 15 is extended or contracted by rotation of handle 16 or operation of a motor (not shown) to positions from "horizon" to "horizon" about the longitudinal axis of the elongated cross member. See element 9.

Figure 5:
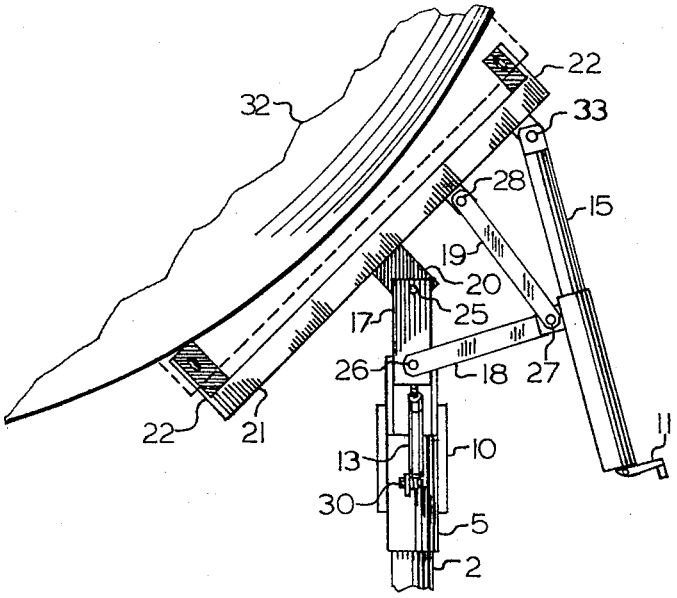
FIGS. 5, 6 and 7 are plan views of the invention showing an antenna in various positions about the longitudinal axis of the mount's elongated cross member.
Figure 6:
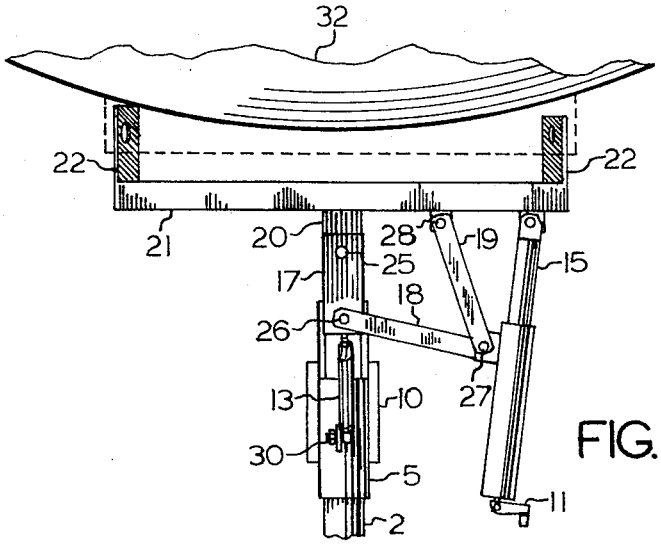
Figure 7:
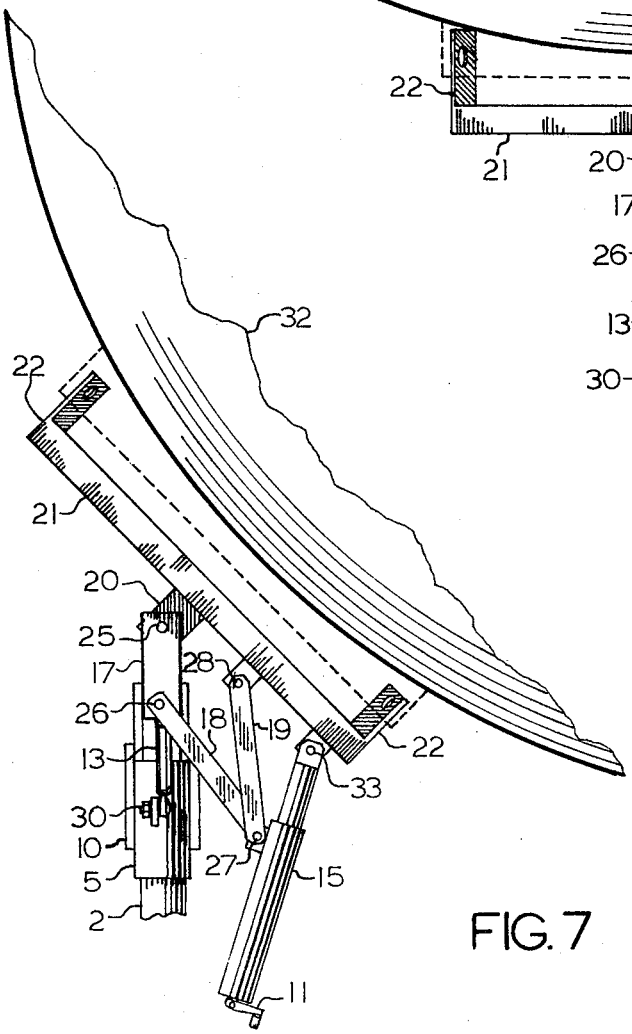

To appreciate the various positions frame 21 can be placed in by elements 15, 17, 18, 19 and 20, reference is made to FIGS. 5, 6 and 7. FIG. 5 shows the jack means 15 fully extended, to position frame 21 to the extreme left position. In FIG. 7 the jack is in its most collapsed position showing frame 21 in its extreme right-handed position. In FIG. 6, jack 15 is extended so as to position frame 21 in an intermediate position between that shown by FIGS. 5 and 7.

On frame 21 are two types of upstanding members 22 and 23. Frame 21 is rectangular in shape and the upstanding member 22 and 23 occupy an equal number of the four corners, i.e., two each. It will be noted that on two contiguous corners of frame 21 there is disposed upstanding members 22 and at the other two corners of the rectangular frame 21 are upstanding members 23. The height or length of upstanding members 22 is longer than that of those of upstanding members 23. In Catawba County, N.C., upstanding members 22 have a length that is twice that of upstanding members 23. Such will not always be the case because in other locations on the face of the earth, the relative height of elements 22 and 23 may change according to their geographic location, i.e., the way they "see" the satellite path.

The purpose of the upstanding members 22 and 23 and their relative differences in length and height refers back to the problem created by an antenna being located at a fixed position on the earth and what it "sees" as it attempts to aim itself towards various earth orbiting satellites. What an antenna should "see" is a trail or path created by a line drawn from satellite to satellite, from horizon to horizon. Such a path is not a circular but an ecliptical-like path shown schematically in FIG. 1. By use of upstanding members 22 and 23, their relative difference in height or length, in combination with frame 21 and linkage assembly attached thereto, frame 21 can be positioned by jack 15, to follow such ecliptical-like satellite path from horizon to horizon.

In summary, there has been disclosed a mount adapted primarily for use with dish shaped antenna and more particularly useful for positioning or aiming such antenna at earth orbiting equatorial satellites which transmit television signals. The mount is primarily composed of four basic parts, a base, a means attached to the base for vertical and rotational positioning of elements of the mount, an elongated cross member pivotally attached to the vertical and rotational means, and a means attached to the elongated cross member for rotationally positioning a frame of the mount about the longitudinal axis of the elongated cross member. The base, co-acting with the means for vertically and rotationally positioning the mount, makes possible an adjustment of the mount along the y axis and a 360° rotational positioning. The tube like member contains on one terminal portion thereof a yoke in which is nested and pivotally attached to an elongated cross member. A turn buckle means attaches the elongated cross member to the means for vertical and rotational movement and permits adjustment or positioning of the elongated member about the y axis in the plane formed by the mount's vertical axis and the longitudinal axis of the elongated cross member. To both ends of the elongated cross member is pivotally attached a frame and at one of such ends there is attached thereto a linkage system whereby the frame itself can be rotated about the longitudinal axis of the elongated cross member from "horizon" to "horizon" by means of a jack in combination with the linkage assembly. The frame itself is rectangular in shape and contains four upstanding members at each of its corners. Two of the upstanding members have a length greater than the other two and are contiguously positioned at their respective corners at one end of the frame and the shorter upstanding members are contiguously positioned at their respective corners at the other end of the frame.

Various modifications and variations will no doubt occur to those skilled in the art to which this invention pertains. These and all variations within the scope of the pending claims are considered to be part of the invention.

What is claimed is:

1. A mount for use with a dish type antenna for variably positioning an antenna towards a predetermined point in the heavens comprising:
   (a) an upstanding base means;
   (b) a means attached to said upstanding base means for rotationally positioning the antenna about or along the vertical axis of the mount;
   (c) an elongated cross member attached to the means of subparagraph (b), for variably positioning the antenna in the plane formed by the longitudinal axis of said elongated cross member and the mount's vertical axis; and,
   (d) a linkage frame means, attached to the elongated cross member for variably positioning the antenna about the longitudinal axis of said cross member, said linkage frame means comprising a frame pivotally attached to said elongated member; a jack pivotally attached to said elongated member and to said frame; and, first and second linkage arms both pivotally attached to said jack and one to said frame and the other to said elongated member.

2. The mount of claim 1 wherein the means of subparagraph (b) is in slidable engagement with said upstanding base means, and contains a means to removably affix it to said upstanding base means.

3. The mount of claim 2 wherein part of said upstanding base means is tubular in shape.

4. The mount of claim 3 wherein a portion of said means of subparagraph (b) is tubular in shape and is adapted to rotate about the mount's vertical axis and be fixedly positioned along said axis.

5. The mount of claim 2 wherein one terminal portion of the means of subparagraph (b) contains a means for pivotally affixing it to the elongated cross member.

6. The mount of claim 5 wherein said means for pivotally affixing the means of subparagraph (b) to the elongated cross member is a yoke.

7. The mount of claim 1 containing a turn buckle wherein said turn buckle is rotatably affixed to a terminal portion of the means of subparagraph (b) and to said elongated cross member.

8. The mount of claim 1 wherein the linkage-frame means contains a third linkage arm pivotally attached to said second linkage arm and to said frame and fixedly attached to said elongated member.

9. The mount of claim 1 wherein the linkage-frame means contains upstanding members affixed thereto adapted to be attached to an antenna, some of the said upstanding members having a greater length than others.

10. The mount of claim 1 containing a dish shaped antenna attached to the linkage-frame means.

11. The mount of claim 1 containing an antenna attached to said frame.

12. The mount of claim 9 containing an antenna attached to said upstanding members.

13. A means for positioning an antenna about the longitudinal axis of a horizontal member comprising an elongated member, a frame pivotally attached to said elongated member; a jack pivotally attached to said frame; and, first and second linkage arms both pivotally attached to said jack one pivotally attached to said frame and the other to said elongated member.

14. The positioning means of claim 13 wherein said frame contains a number of upstanding members affixed thereto, some of which having a length greater than others.

15. The positioning means of claim 14 wherein said frame is rectangular in shape and said upstanding members thereon are four in number, two being of greater length than the remainder and positioned at the corners of the frame contiguous to one another.

* * * * *